US008522734B2

(12) United States Patent
Adachi et al.

(10) Patent No.: US 8,522,734 B2
(45) Date of Patent: Sep. 3, 2013

(54) VALVE TIMING CONTROL DEVICE

(75) Inventors: Kazunari Adachi, Chiryu (JP); Masaki Kobayashi, Okazaki (JP); Kenji Fujiwaki, Kariya (JP); Mitsuru Uozaki, Obu (JP); Kenji Ikeda, Anjo (JP); Shohei Masuda, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 198 days.

(21) Appl. No.: 12/748,498

(22) Filed: Mar. 29, 2010

(65) Prior Publication Data

US 2010/0294223 A1 Nov. 25, 2010

(30) Foreign Application Priority Data

May 25, 2009 (JP) ..... 2009-125754

(51) Int. Cl.
*F01L 1/34* (2006.01)

(52) U.S. Cl.
USPC ..... 123/90.15; 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,382,156 | B1 | 5/2002 | Fukuhara et al. | |
| 6,453,860 | B1 | 9/2002 | Hase | |
| 6,976,460 | B2 * | 12/2005 | Komazawa et al. | 123/90.15 |
| 2002/0121253 | A1 | 9/2002 | Hase | |
| 2006/0124093 | A1 * | 6/2006 | Kanada et al. | 123/90.17 |
| 2007/0144475 | A1 * | 6/2007 | Suzuki et al. | 123/90.17 |
| 2008/0163838 | A1 | 7/2008 | Iwata et al. | |

FOREIGN PATENT DOCUMENTS

| | | | |
|---|---|---|---|
| EP | 1 857 643 | A1 | 11/2007 |
| EP | 1857643 | A1 * | 11/2007 |
| JP | 2000-179310 | A | 6/2000 |
| JP | 2002-188415 | A | 7/2002 |
| JP | 2002-256825 | A | 9/2002 |
| JP | 2006-249970 | A | 9/2006 |
| JP | 2007-247509 | A | 9/2007 |
| JP | 2008-215312 | A | 9/2008 |

OTHER PUBLICATIONS

Extended European Search Report issued by the European Patent Office in EP 10 00 2766, mailed Oct. 18, 2010, The Hague, NL, 5 pgs.
Japanese Office Action (Reasonsl) issued Apr. 18, 2013 by the Japanese Patent Office in Japanese Patent Application No. 2009-125754 and English language translation of Japanese Office Action (6 pages).

* cited by examiner

*Primary Examiner* — Thomas Denion
*Assistant Examiner* — Steven D Shipe
(74) *Attorney, Agent, or Firm* — Buchanan Ingersoll & Rooney PC

(57) ABSTRACT

A valve timing control device includes: a driving side rotational member; a driven side rotational member; a fluid pressure chamber; a partition portion; a lock member; a lock groove; and a lock release, wherein the lock release passage is in communication with the lock groove, and the rotational member formed with the accommodation portion is provided with an atmosphere open passage which is in communication with the lock groove when the relative rotational phase is at a specific phase.

18 Claims, 8 Drawing Sheets

VALVE TIMING CONTROL DEVICE

This application is based on and claims priority under 35 U.S.C. §119 to Japanese Patent Application 2009-125754, filed on May 25, 2009, the entire content of which is incorporated herein by reference.

TECHNICAL FIELD

This disclosure relates to a valve timing control device including a driving side rotational member synchronously rotatable with a crankshaft of an internal combustion engine, a driven side rotational member arranged coaxially with the driving side rotational member and synchronously rotatable with a camshaft that controls the opening and closing operation of valves of the internal combustion engine, a fluid pressure chamber formed by the driving side rotational member and the driven side rotational member, a partition portion installed on at least one of the driving side rotational member and the driven side rotational member to partition the fluid pressure chamber into an advanced angle chamber and a retarded angle chamber, a lock member mounted in an accommodation portion formed in either the driving side rotational member or the driven side rotational member and protruding and withdrawing with respect to the rotational member opposite to the accommodation portion, a lock groove formed in the opposite rotational member so that the lock member protrudes and is locked to the lock groove, the lock groove confining a relative rotational phase of the driven side rotational member with respect to the driving side rotational member at a most advanced angle phase, a most retarded angle, or a predetermined phase between the most advanced angle phase and the most retarded angle phase when the lock member is locked, and a lock release passage supplying an operating fluid to the lock member to withdraw the lock member from the lock groove.

BACKGROUND DISCUSSION

In a valve timing control device, when an operating fluid of a lock release passage is acted on a lock member to withdraw the lock member from a lock groove, if foreign substances, such as minute metal pieces or metal powder, are mixed with the operating fluid, the foreign substances tend to stay in the lock groove. If the foreign substances are jammed between the lock member and the lock groove, it is a hindrance in the smooth displacement of the lock member, which is liable to result in a bad influence on the extending or withdrawing operation of the lock member.

For this reason, a valve timing control device of a related art has a foreign substance receiving space in the rotational member formed with an accommodation portion for the lock member, in which the foreign substance receiving space is communicated with the lock groove when the relative rotational phase of a driven side rotational member with respect to the driving side rotational member is adjusted at a specific phase. Since the foreign substances are collected in the foreign substance receiving space, the jamming of the foreign substances is prevented (e.g., refer to JP-A-2007-247509 (Patent Document 1)).

In the related art, the jamming of the foreign substances is prevented by collecting the foreign substances in the foreign substance receiving space. Therefore, as the foreign substances are stacked in the foreign substance receiving space, the stacked foreign substances are liable to flow out toward the lock groove in accordance with rotation stop of the internal combustion engine. As a result, there is a drawback in that it is difficult to prevent the foreign substances from jamming between the lock member and the lock groove for a long period of time.

A need thus exists for a valve timing control device which is not susceptible to the drawback mentioned above.

SUMMARY

According to a first aspect of this disclosure, a valve timing control device includes a driving side rotational member synchronously rotatable with a crankshaft of an internal combustion engine; a driven side rotational member arranged coaxially with the driving side rotational member and synchronously rotatable with the camshaft that controls the opening and closing operation of valves of the internal combustion engine; a fluid pressure chamber formed by the driving side rotational member and the driven side rotational member; a partition portion installed on at least one of the driving side rotational member and the driven side rotational member to partition the fluid pressure chamber into an advanced angle chamber and a retarded angle chamber; a lock member mounted in an accommodation portion formed in either the driving side rotational member or the driven side rotational member and protruding and withdrawing with respect to the rotational member opposite to the accommodation portion; a lock groove formed in the opposite rotational member so that the lock member protrudes and is locked to the lock groove, the lock groove confining a relative rotational phase of the driven side rotational member with respect to the driving side rotational member at a most advanced angle phase, a most retarded angle, or a predetermined phase between the most advanced angle phase and the most retarded angle when the lock member is locked; and a lock release passage supplying an operating fluid to the lock member to withdraw the lock member from the lock groove, wherein the lock release passage is in communication with the lock groove, and the rotational member formed with the accommodation portion is provided with an atmosphere open passage which is in communication with the lock groove when the relative rotational phase is at a specific phase.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments disclosed here will now be described with reference to the accompanying drawings.

First Embodiment

Figure 1:
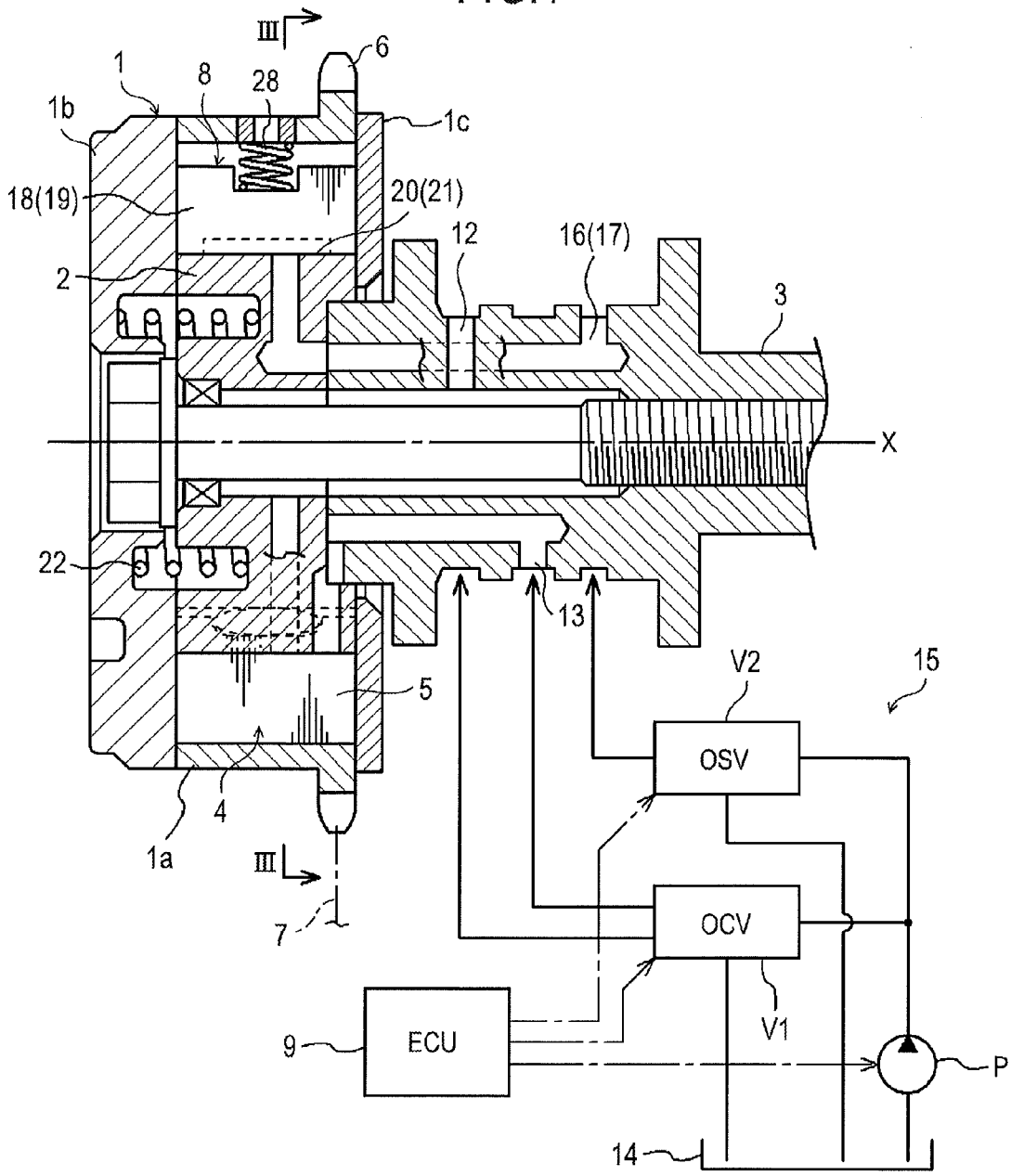
FIG. 1 is a cross-sectional view illustrating an overall structure of a valve timing control device.
Figure 2:
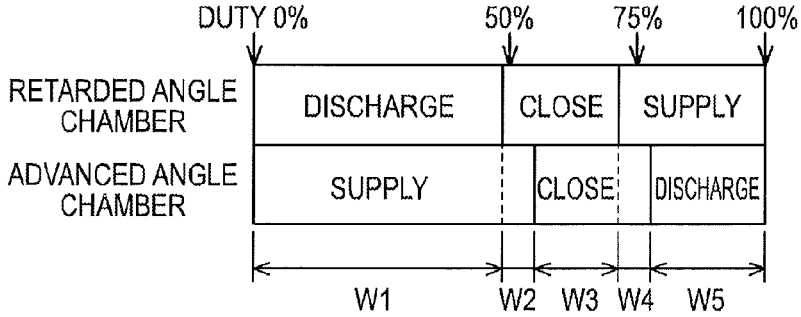
FIG. 2 is a perspective view illustrating the operating configuration of a fluid control valve.

FIG. 1 is a side cross-sectional view illustrating an overall structure of a valve timing control device according to an embodiment disclosed here. FIG. 2 is a view illustrating the operating configuration of a fluid control valve (OCV) V1 installed in the valve timing control device. FIGS. 3, 4, 5A, 6A and 7 are cross-sectional views taken along the line III-III in FIG. 1 in each operation state of the valve timing control device. FIGS. 5B and 6B are cross-sectional views of a major portion.

A valve timing control device includes an outer rotor 1 serving as a driving side rotational member and synchronously rotatable with a crankshaft (not shown) of an engine (an internal combustion engine) in a direction denoted by an arrow S in the figure, and an inner rotor 2 serving as a driven side rotational member and synchronously rotatable with a camshaft 3 which opens and closes a valve of the engine, in a direction denoted by the arrow S in the figure, in which the inner rotor 2 is supported on an inner periphery of the outer rotor 1 and rotates relatively with respect to the outer rotor 1.

The outer rotor 1 and the inner rotor 2 are coaxially arranged in such a manner that they are relatively slidable and rotatable around a core X of a rotational shaft. A fluid pressure chamber 4 is formed between the outer rotor 1 and the inner rotor 2. The fluid pressure chamber 4 is partitioned into a retarded angle chamber 4*a* and an advanced angle chamber 4*b* by a vane 5 serving as a partition portion installed therein.

If operating oil is supplied to the retarded angle chamber 4*a* or the advanced angle chamber 4*b*, the outer rotor 1 and the inner rotor 2 rotate relatively. If the volume of the retarded angle chamber 4*a* is increased, the relative rotational phase of the inner rotor 2 with respect to the outer rotor 1 is displaced towards a retarded angle side (in a direction of the arrow S1 in the figure). If the volume of the advanced angle chamber 4*b* is increased, the same relative rotational phase of the inner rotor 2 with respect to the outer rotor 1 is displaced towards an advanced angle side (in a direction of the arrow S2 in the figure).

The outer rotor 1 includes a cylindrical rotor body 1*a* externally carried to be relatively slidable and rotatable within a predetermined phase range extending between a most advanced angle phase and a most retarded angle phase with respect to the inner rotor 2, and a front plate 1*b* and a rear plate 1*c* which are connected to the rotor body 1*a* at front and rear sides thereof by a screw or the like. A timing sprocket 6 is integrally installed on the rotor body 1*a*.

Between the timing sprocket 6 and the gear mounted on the crankshaft of the engine, there is provided a power transmission member 7 such as a timing belt.

If the crankshaft of the engine rotates, a rotational force is transmitted to the timing sprocket 6 through the power transmission member 7, and the outer rotor 1 rotates in a rotational direction shown by the arrow S in the figure.

Upon rotation of the outer rotor 1, the inner rotor 2 rotates in the same rotational direction as the outer rotor 1 to rotate the camshaft 3, and a cam provided on the camshaft 3 pushes an intake valve or an exhaust valve down to open the valve.

Figure 3:
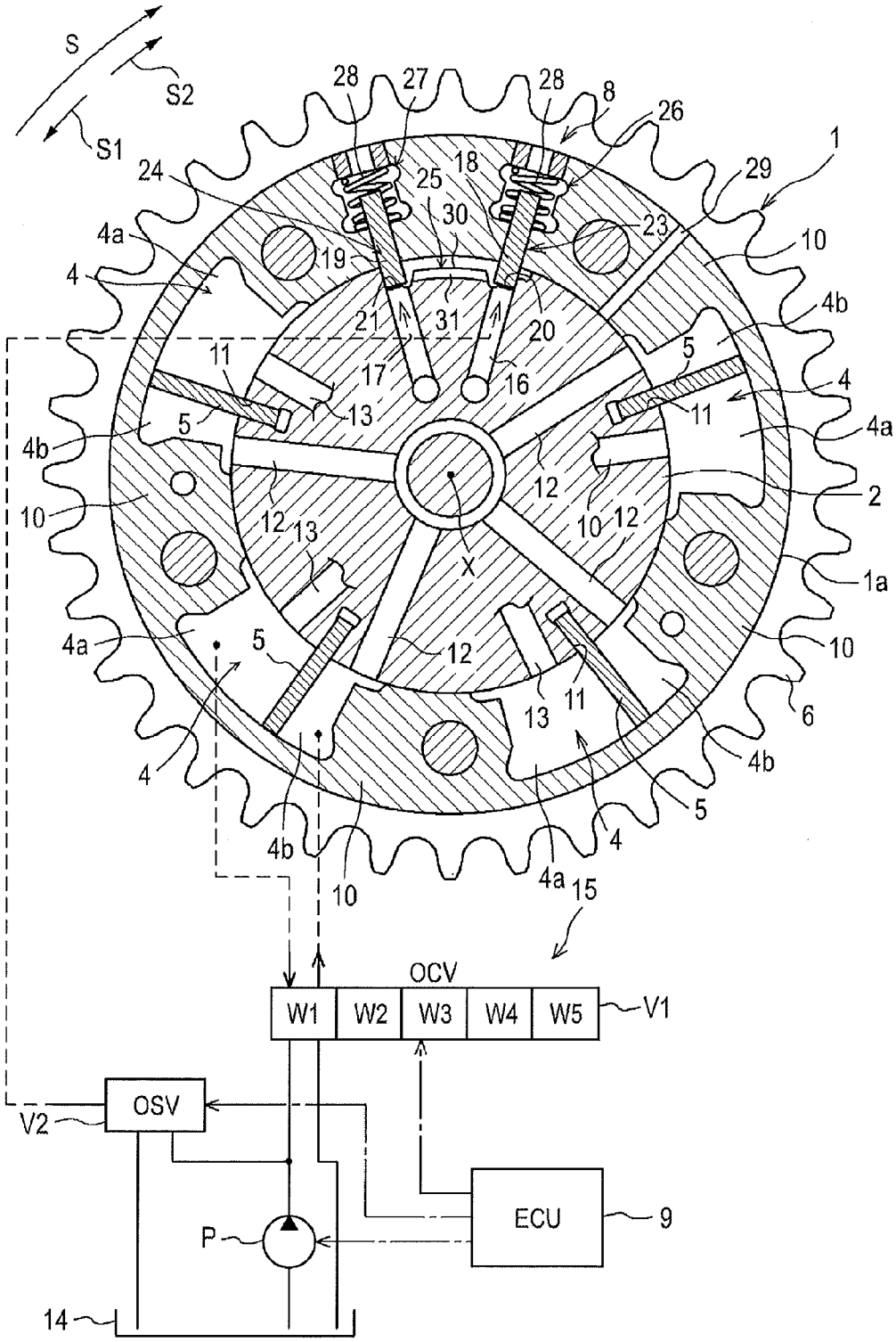
FIG. 3 is a cross-sectional view taken along the line in FIG. 1 in a specific operation state.

The valve timing control device includes a lock mechanism 8 that controls the relative rotational phase of the inner rotor 2 with respect to the outer rotor 1 at an intermediate lock phase which is suitable for the start of an internal combustion engine between the most advanced angle phase and the most retarded angle phase, as shown in FIG. 3.

The engine is provided with a sensor detecting a current crank angle and a sensor detecting an angle phase of the camshaft 3.

An electronic control unit (ECU) 9 controlling the valve timing control device disclosed here includes a phase judgment mechanism which detects the relative rotational phase of the inner rotor 2 with respect to the outer rotor 1 from the detect result of these sensors to judge whether the relative rotational phase is the advanced angle phase or the retarded angle phase with respect to the intermediate lock phase.

The electronic control unit 9 is adapted to store and save the optimum relative rotational phase in accordance with a driving state of the engine in a memory, and to recognize the optimum relative rotational phase with respect to the driving state (engine revolutions, temperature of cooling water or the like) separately detected.

Accordingly, the electronic control unit 9 generates and outputs a control command controlling the relative rotational phase so as to make the relative rotational phase suitable for the driving state of the engine. Further, the electronic control unit 9 is adapted to receive ON/OFF information from an ignition key, and information from an oil temperature sensor detecting the temperature of engine oil, or the like.

In this embodiment, as the revolutions of the engine increase, the relative rotational phase is adjusted to be near the most advanced angle phase. In this instance, in a case in which the relative rotational phase is adjusted to be near the most advanced angle phase, large output torque, such as start at the incline, is required, as well as a case in which the revolutions of the engine are high. Even though the revolutions of the engine are low, the relative rotational phase is near the most advanced angle phase.

The configuration of the valve timing control device disclosed here will now be described in detail.

(Fluid Pressure Chamber)

As shown in FIG. 3 to FIG. 7, a plurality of protrusions 10 each serving as a shoe protruding in a radially inner direction are arranged on the rotor body 1*a* of the outer rotor 1 at intervals from each other along the rotational direction. A fluid pressure chamber 4 is formed between adjacent protrusions 10 of the outer rotor 1.

A vane groove 11 is formed on an external periphery portion of the inner rotor 2 facing each fluid pressure chamber 10. A vane 5 partitioning the inside of the fluid pressure chamber 4 into an advanced angle chamber 4*a* and a retarded angle chamber 4*b* which are adjacent to each other in a relative rotational direction (i.e. in the direction of arrows S1 and S2 in the figure) is slidably supported in the vane groove 11 along a radial direction of the rotational member.

The advanced angle chamber 4*b* is in communication with an advanced angle passage 12 formed on the inner rotor 2, and the retarded angle chamber 4*a* is in communication with a retarded angle passage 13 formed on the inner rotor 2. The advanced angle passage 12 and the retarded angle passage 13 are connected to an oil pressure circuit 15 which is connected to an oil pan 14 of the engine.

(Oil Pressure Circuit)

The oil pressure circuit 15 performs supply and discharge of the engine oil to and from either or both of the advanced angle chamber 4*b* and the retarded angle chamber 4*a* through the advanced angle passage 12 and the retarded angle passage 13 as the operating oil to change the position of the vane 5 in the fluid pressure chamber 4. Consequently, the oil pressure circuit serves as a phase control mechanism capable of adjusting the relative rotational phase of the inner rotor 2 with respect to the outer rotor 1 within a phase range extending over the most advanced angle phase (the relative rotational phase when the volume of the advanced angle chamber 4*b* is maximized) and the most retarded angle phase (the relative rotational phase when the volume of the retarded angle chamber 4*a* is maximized).

More specifically, the oil pressure circuit 15 includes, as shown in FIG. 1 and FIG. 3, a pump P driven by the driving force of the engine to supply the engine oil serving as the operating oil (one example of the operating fluid) to a fluid control valve (OCV) V1 and a fluid switching valve (OSV) V2. Revolutions of the pump are controlled in accordance with a control command from the electronic control unit 9.

The advanced angle passage 12 and the retarded angle passage 13 are connected to desired ports of the fluid control valve V1, and a retarded angle restriction-lock release passage 16 and an advanced angle restriction-lock release passage 17 which will be described below are connected to desired ports of the fluid switching valve V2.

The supply and discharge of the operating oil to and from the fluid pressure chamber 4 (the retarded angle chamber 4*a* and the advanced angle chamber 4*b*) is performed by the pump P arranged in the oil pressure circuit 15 and the fluid control valve V1 of a spool type.

As shown in FIG. 2 and FIG. 3, the fluid control valve V1 can adjust the supply amount and the discharge amount of the operating oil to and from the advanced angle chamber 4*b* and the retarded angle chamber 4*a* by performing a switching control of a spool position among a first state W1 in which the operating oil is supplied to the advanced chamber 4*b* and is discharged from the retarded angle chamber 4*a*, a second state W2 in which the operating oil is supplied to advanced angle chamber 4*b* and the retarded angle passage 13 is closed, a third state W3 in which both of the advanced angle passage 12 and the retarded angle passage 13 are closed and the supply of the operating oil to both of the advanced angle chamber 4*b* and the retarded angle chamber 4*a* is stopped, a fourth state W4 in which the advanced angle passage 12 is closed and the operating oil is supplied to the retarded angle chamber 4*a*, and a fifth state W5 in which the operating oil is discharged from the advanced angle chamber 4*b* and the operating oil is supplied to the retarded angle chamber 4*a*.

More specifically, since the electronic control unit 9 controls the amount of electricity supplied to a linear solenoid (not shown) installed in the fluid control valve V1, the position of the spool slidably supported in the housing of the fluid control valve V1 is adjusted in left and right positions in FIG. 3. However, in FIG. 2, as the position of the spool is shifted from Duty 0% to Duty 50%, the degree of opening in the advanced angle passage 12 is gradually decreased. Similarly, as the position of the spool is shifted from Duty 100% to Duty 75%, the degree of opening in the retarded angle passage 13 is gradually decreased.

The fluid switching valve V2 performs the lock and the lock release at the intermediate lock phase by supplying and discharging the operating oil to and from the lock mechanism 8.

That is, the locking and releasing operation of a retarded angle restriction-lock piece (one example of the lock member) 18 to and from the retarded angle restriction-lock groove 20 and the locking and releasing operation of an advanced angle restriction-lock piece (one example of the lock member) 19 to and from the advanced angle restriction-lock groove 21 are performed by the fluid switching valve V2 which is operated independently from the oil pressure control by the fluid control valve V1. For this reason, in a state in which the oil pressure is not stable immediately after the engine stops, each of the lock pieces 18 and 19 can be easily locked to the lock grooves 20 and 21 reliably.

In this embodiment, the lock grooves 20 and 21 and the lock release passages 16 and 17 are not in communication with the retarded angle chamber 4*a*, the advanced angle chamber 4*b*, the advanced angle passage 12 and the retarded angle passage 13. For this reason, for example, even though the operating oil is discharged from the advanced angle chamber 4*b* or the retarded angle chamber 4*a* when the fluid control valve V1 is in the first state W1 or the fifth state W5, the operating oil is not discharged from the lock grooves 20 and 21 and the lock release passages 16 and 17.

(Biasing Mechanism)

As shown in FIG. 1, a torsion spring 22 serving as a biasing mechanism for biasing the relative rotational phase of both rotors 1 and 2 towards the advanced angle side is installed between the inner rotor 2 and the outer rotor 1.

The torsion spring 22 biases the inner rotor 2 to the outer rotor 1 in the direction (advanced angle side) denoted by the arrow S2. Consequently, this serves to solve the problem of the relative phase of the inner rotor 2 rotating integrally with the camshaft 3 being frequently delayed to the rotation of the outer rotor 1 since the camshaft 3 receives the resistance from the valve spring.

(Lock Mechanism)

As shown in FIG. 3 to FIG. 7, the lock mechanism 8 includes the retarded angle restriction-lock portion 23 and the advanced angle restriction-lock portion 24 provided in the outer rotor 1, and a lock concave portion 25 formed in the outer circumference of the inner rotor 2 in a groove shape along an arc around the core X of the rotational shaft thereof.

The retarded angle restriction-lock portion 23 has a retarded angle restriction-lock piece 18, and the advanced angle restriction-lock portion 24 has an advanced angle restriction-lock piece 19.

The retarded angle restriction-lock piece 18 is mounted so as to be protruded or withdrawn to or from a retarded angle-accommodating portion 26 formed in the outer rotor 1 with respect to the inner rotor 2, and the advanced angle restriction-lock piece 19 is mounted so as to be protruded or withdrawn to or from an advanced angle-accommodating portion 27 formed in the outer rotor 1 with respect to the inner rotor 2.

The lock concave portion 25 is formed in a groove shape extending over the entire width along the core X of the relative rotational shaft of the inner rotor 2, and is installed in such a manner that each of the retarded angle restriction-lock piece 18 and the advanced angle-restriction-lock piece 19 protrudes and abuts against a bottom surface of the lock concave portion.

At the inside of the lock concave portion 25 two lock grooves of the retarded angle restriction-lock groove 20 and the advanced angle restriction-lock groove 21 are dividedly arranged and opened at both ends in the circumferential direction thereof.

Consequently, the retarded angle restriction-lock groove 20 and the advanced angle restriction-lock groove 21 are in communication with each other through the lock concave portion 25.

The front end portion of the retarded angle restriction-lock piece 18 protruding toward the inner rotor 2 can be locked to the retarded angle restriction-lock groove 20. The front end portion of the advanced angle restriction-lock piece 19 protruding toward the inner rotor 2 can be locked to the advanced angle restriction-lock groove 21.

The length of the lock concave portion 25 in the circumferential direction of the rotational member is set in such a manner that the retarded angle restriction-lock piece 18 and the advanced angle restriction lock-piece 19 are simultaneously locked to the lock grooves 20 and 21, respectively.

As shown in FIG. 3, when the retarded angle restriction-lock piece 18 is locked to the retarded angle restriction-lock groove 20 and the advanced angle restriction-lock piece 19 is locked to the advanced angle restriction-lock groove 21, the relative rotational phase of the inner rotor 2 with respect to the outer rotor 1 is restricted at the intermediate lock phase.

Each of the retarded angle restriction-lock piece 18 and the advanced angle restriction-lock piece 19 is provided with a spring 28 biasing the lock pieces to protrude the lock pieces toward the inner rotor 2. The spring 28 is installed in such a manner that the lock pieces can be switched to a lock posture in which the lock pieces are locked to the lock grooves 20 and 21 by the biasing force of the spring 28, and a lock release posture in which the lock pieces are withdrawn from the lock grooves 20 and 21 against the biasing force of the spring 28.

A rod-type lock pin may be employed as the lock pieces 18 and 19, in addition to the lock piece of a plate shape shown in this embodiment.

The retarded angle-lock release passage 16 is in communication with the bottom surface of the retarded angle restriction-lock groove 20, and the advanced angle-lock release passage 17 is in communication with the bottom surface of the advanced angle restriction-lock groove 21.

Since the operating oil of the retarded angle-lock release passage 16 acts on the retarded angle restriction-lock piece 18 of the lock posture, the retarded angle restriction-lock piece 18 can be withdrawn from the retarded angle restriction-lock groove 20, and be switched to the lock release posture.

Since the operating oil of the advanced angle-lock release passage 17 acts on the advanced angle restriction-lock piece 19 of the lock posture, the advanced angle restriction-lock piece 19 can be withdrawn from the advanced angle restriction-lock groove 21, and be switched to the lock release posture.

Since the retarded angle restriction-lock piece 18 protrudes from the lock concave portion 25, the rotational range of the inner rotor 2 from the intermediate lock phase to the retarded angle side (direction denoted by the arrow S1) with respect to the outer rotor 1 is restricted.

Since the advanced angle restriction-lock piece 19 protrudes from the lock concave portion 25, the rotational range of the inner rotor 2 from the intermediate lock phase to the advanced angle side (direction denoted by the arrow S2) with respect to the outer rotor 1 is restricted.

In the intermediate lock phase, if the retarded angle-lock release passage 16 or the advanced angle-lock release passage 17 is in communication with the oil pan 14 by operation of the fluid switching valve V2, the oil pressure is lowered, as shown in FIG. 3, and the retarded angle restriction-lock piece 18 or the advanced angle restriction-lock piece 19 is switched to the lock posture by the biasing force of the spring 28.

Figure 4:
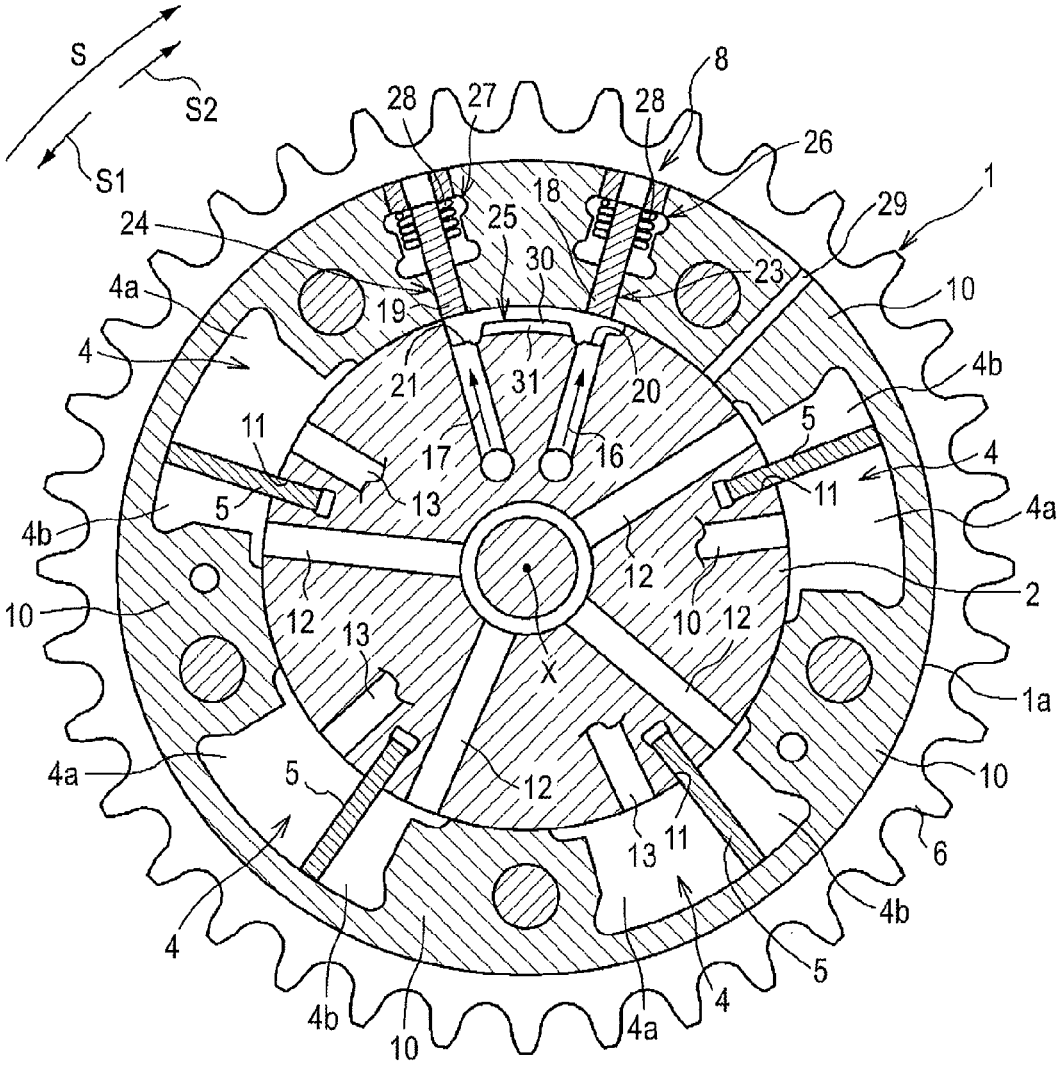
FIG. 4 is a cross-sectional view taken along the line in FIG. 1 in a specific operation state.

Further, if the retarded angle-lock release passage or the advanced angle-lock release passage 17 is in communication with the pump P by operation of the fluid switching valve V2, the oil pressure is raised, as shown in FIG. 4, and the retarded angle restriction-lock piece 18 or the advanced angle restriction-lock piece 19 is switched to the lock release posture, in which the lock piece is withdrawn toward the outer rotor 1, against the biasing force of the spring 28.

The outer rotor 1 is provided with a common atmosphere open passage 29 along a radial direction of the rotational member, which is in communication with the retarded angle restriction-lock groove 20 and the advanced angle restriction-lock groove 21 when the relative rotational phase of the inner rotor 2 with respect to the outer rotor 1 is at a specific phase.

Figure 5A:
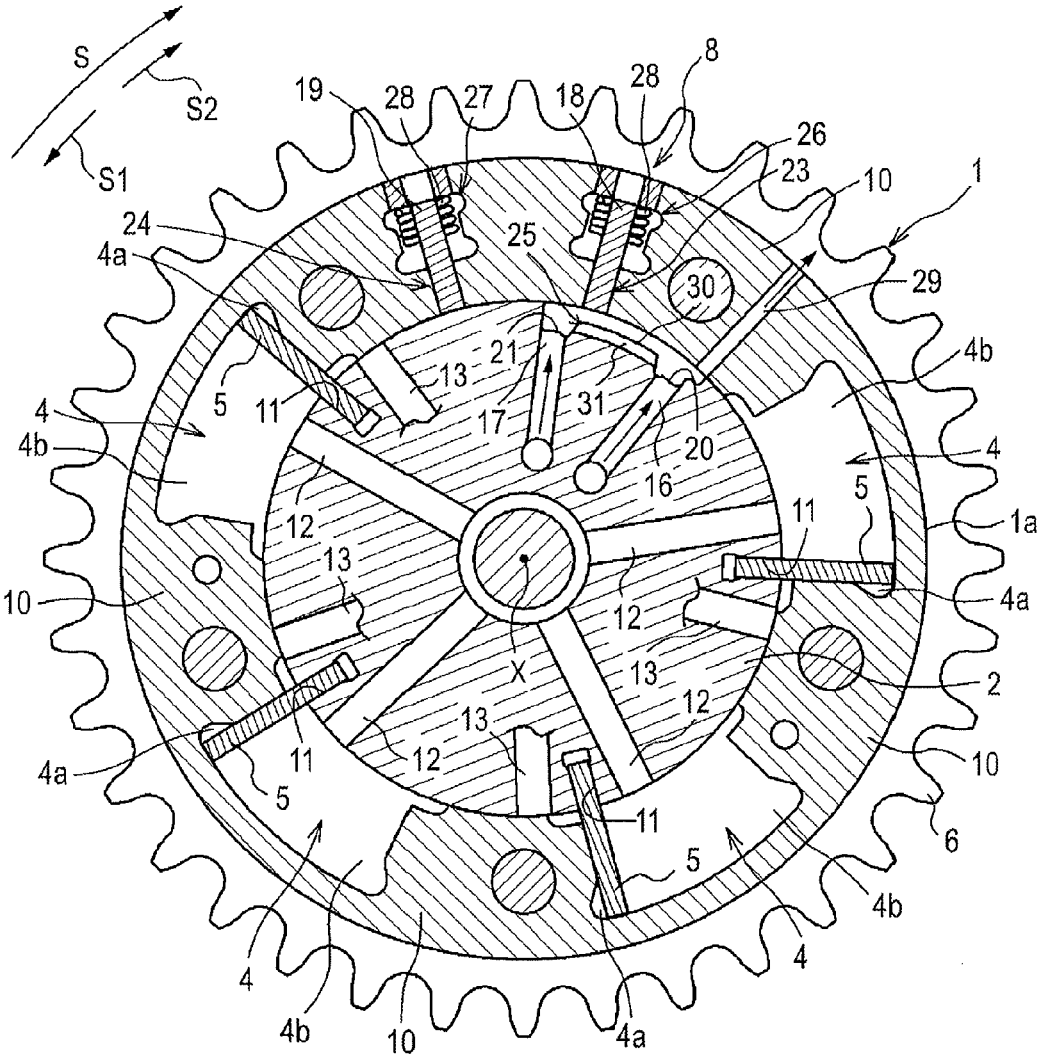
FIG. 5A is a cross-sectional view taken along the line in FIG. 1 in a specific operation state.
Figure 5B:
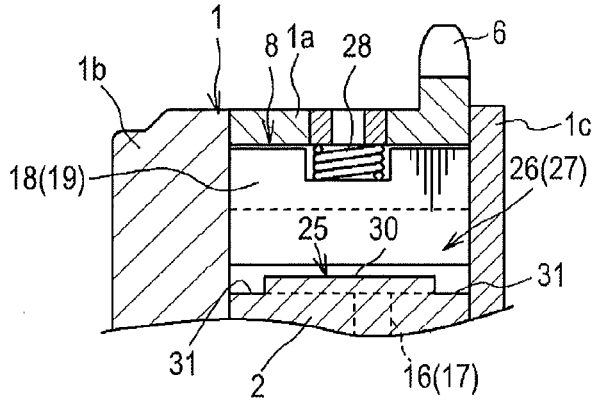
FIG. 5B is a cross-sectional view of a major portion.
Figure 6A:
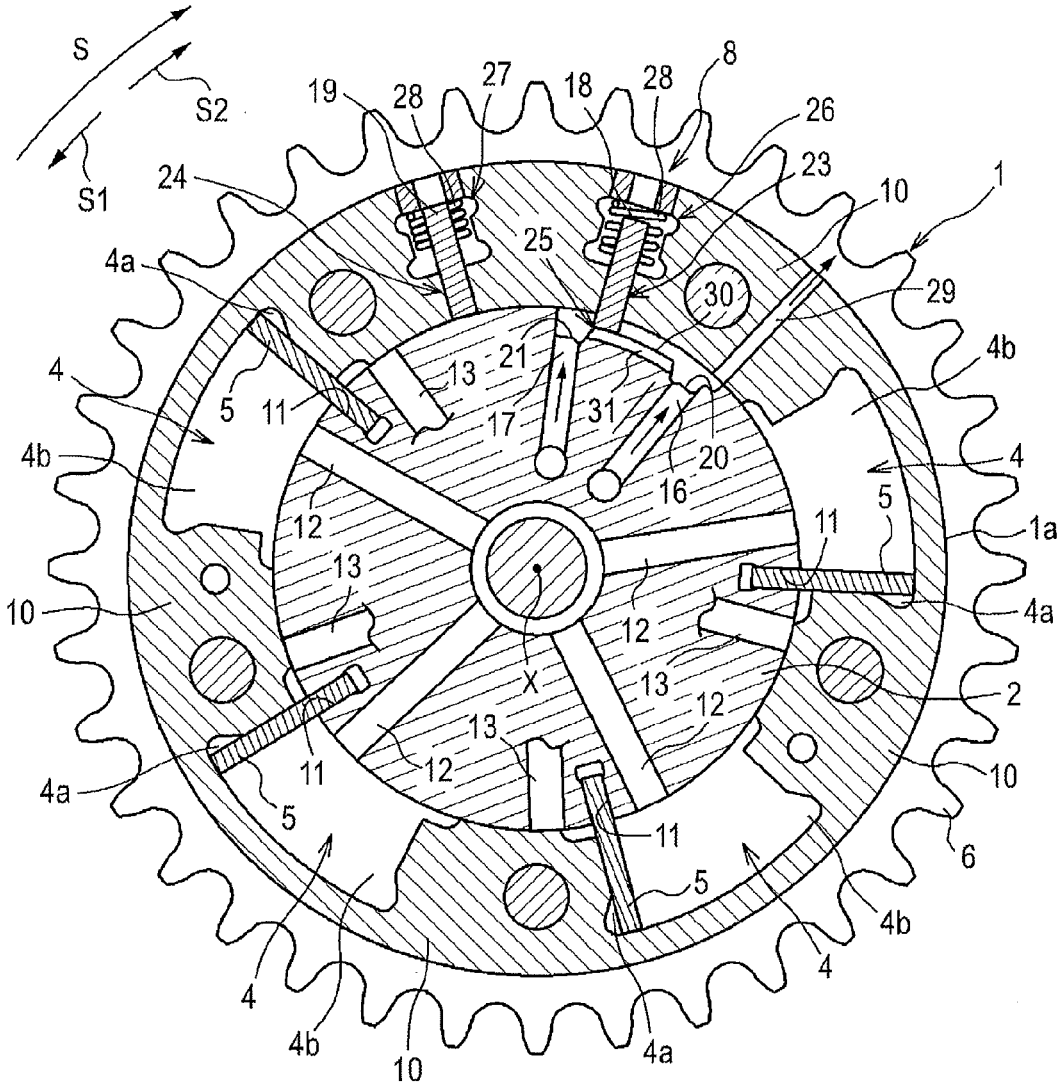
FIG. 6A is a cross-sectional view taken along the line in FIG. 1 in a specific operation state.
Figure 6B:
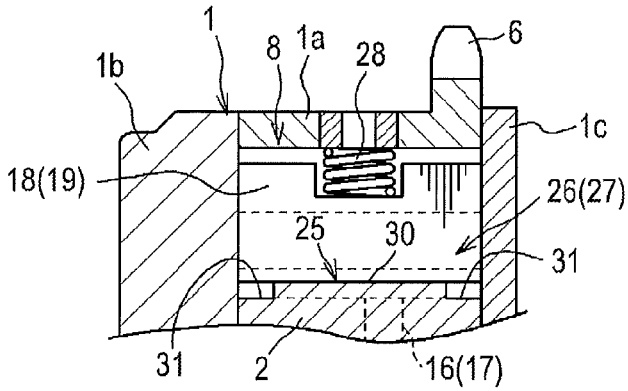
FIG. 6B is a cross-sectional view of a major portion.

The atmosphere open passage 29 is formed in the rotor body 1*a*, and is in communication with the retarded angle restriction-lock groove 20 and the advanced angle restriction-lock groove 21 at the most advanced angle phase to be adjusted when the revolutions of the engine is high at a specific phase, as shown in FIG. 5A. The advanced angle restriction-lock groove 21 is in communication with the atmosphere open passage 29 through the lock concave portion 25.

If the atmosphere open passage 29 is in communication with each of the lock grooves 20 and 21 in a state in which each of the lock release passages 16 and 17 is connected to the pump P, the operating oil of the retarded angle-lock release passage 16 is discharged outwardly from the outer rotor 1 via the retarded angle restriction-lock groove 20 and the atmosphere open passage 29, and the operating oil of the advanced angle-lock release passage 17 is discharged outwardly from outer rotor 1 via the advanced angle restriction-lock groove 21, the lock concave portion 25 and the atmosphere open passage 29.

Consequently, even though the foreign substances mixed with the operating oil stay in the retarded angle restriction-lock groove 20 or the advanced angle restriction-lock groove 21, the foreign substances can be discharged outwardly from the outer rotor 1 via the atmosphere open passage 29 together with the operating oil.

If the atmosphere open passage 29 is in communication with the lock grooves 20 and 21, the pressure of the operating oil in the lock concave portion 25 is lowered. For this reason, the retarded angle restriction-lock piece 18 which is withdrawn toward the outer rotor 1 side at a position near the lock concave portion 25 protrudes and displaces toward the lock concave portion 25 by the biasing force of the spring 28, as shown in FIG. 6B, so that the end portion abuts against the bottom surface 30 of the concave portion. Consequently, the communication between the advanced angle restriction-lock groove 21 and the atmosphere open passage 29 via the lock concave portion 25 may be interrupted.

Accordingly, in order to communicate the advanced angle restriction-lock groove 21 with the atmosphere open passage 29 in a case where the retarded angle restriction-lock piece 18 protrudes and abuts against the bottom portion of the lock concave portion 25 at a specific phase in which the lock grooves 20 and 21 are in communication with the atmosphere open passage 29, the bottom portion of the lock concave portion 25 is provided with a groove 31 along the circumferential direction of the inner rotor 2.

In this embodiment, as shown in FIG. 3, by forming the atmosphere open passage 29 to have a passage cross-section smaller than that of the respective lock release passages 16 and 17, the outflow quantity of the operating oil from the atmosphere open passage 29 via the oil pressure circuit of the fluid switching valve V2 side is suppressed, and sudden deterioration in the pressure of the operating oil in the oil pressure circuit of the fluid control valve V1 side is suppressed.

When the atmosphere open passage 29 is in communication with the lock grooves 20 and 21, the pressure of the operating oil in the fluid pressure chamber 4 is set to be equal to or more than the minimum operating pressure which can adjust the relative rotational phase and to be equal to or more than a pressure which can suppress a fluctuation of the relative rotational phase in the advanced angle direction and the retarded angle direction due to the torque fluctuation acting from the camshaft 3.

The groove 31 is formed at both sides of the bottom surface 30 of the concave portion along the circumferential direction of the rotational member. As shown in FIG. 6B, even though the front end surface of the retarded angle restriction-lock piece 18 abuts against the bottom surface of the concave portion 30, it is possible to ensure the communication of the advanced angle restriction-lock groove 21 with the atmosphere open passage 29 via the groove 31.

Figure 7:
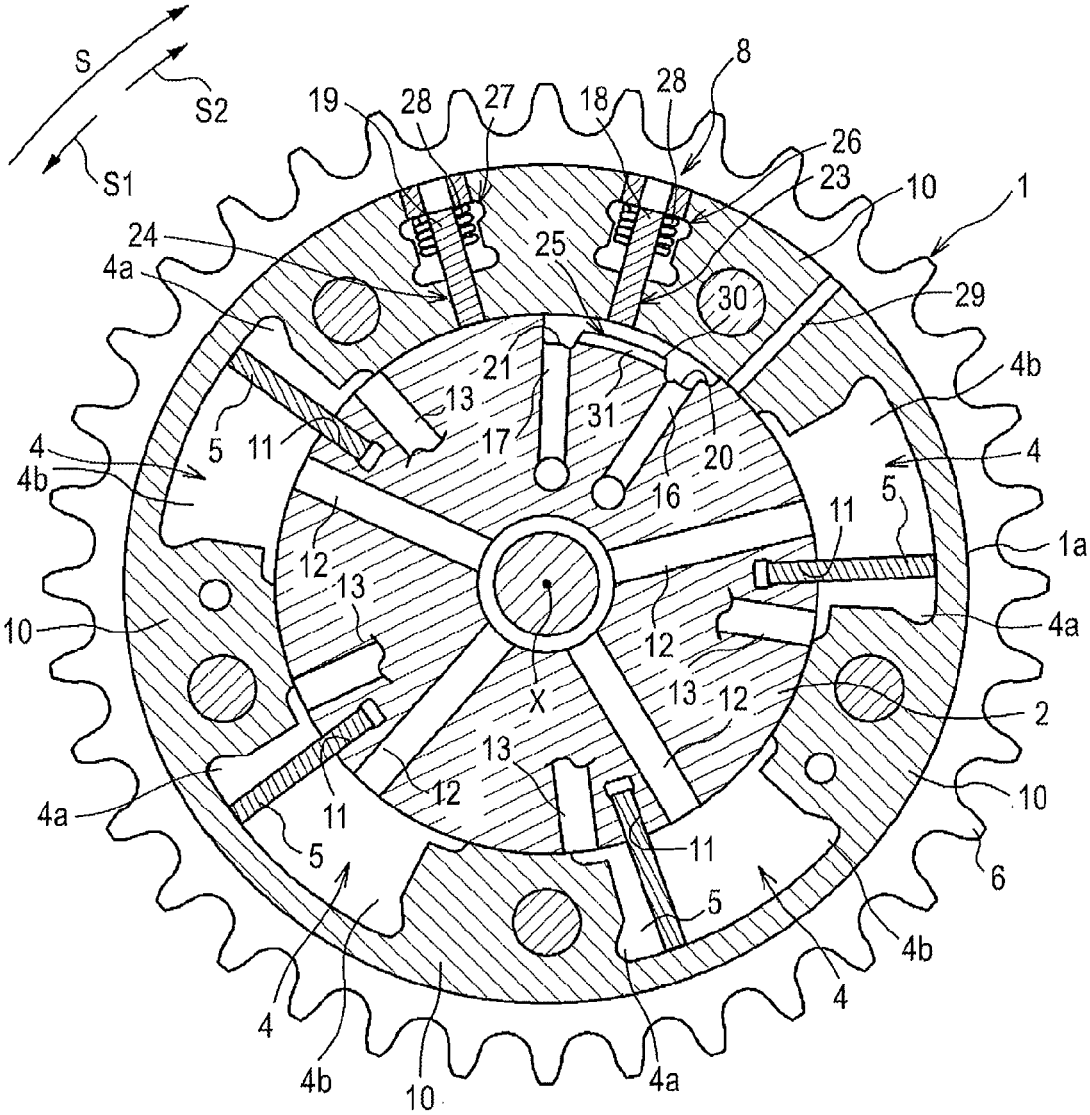
FIG. 7 is a cross-sectional view taken along the line III-III in FIG. 1 in a specific operation state.

After the operating oil is discharged outwardly, as shown in FIG. 7, if the communication of the atmosphere open passage 29 with the lock concave portion 25 is interrupted by displacing the relative rotational phase of the outer rotor 1 and the inner rotor 2 to the retarded angle side, the pressure of the operating oil is increased. Therefore, the retarded angle restriction-lock piece 18 is withdrawn from the lock concave portion 25, and is switched to the lock release posture, thereby adjusting the desired relative rotational phase.

Second Embodiment

Figure 8:
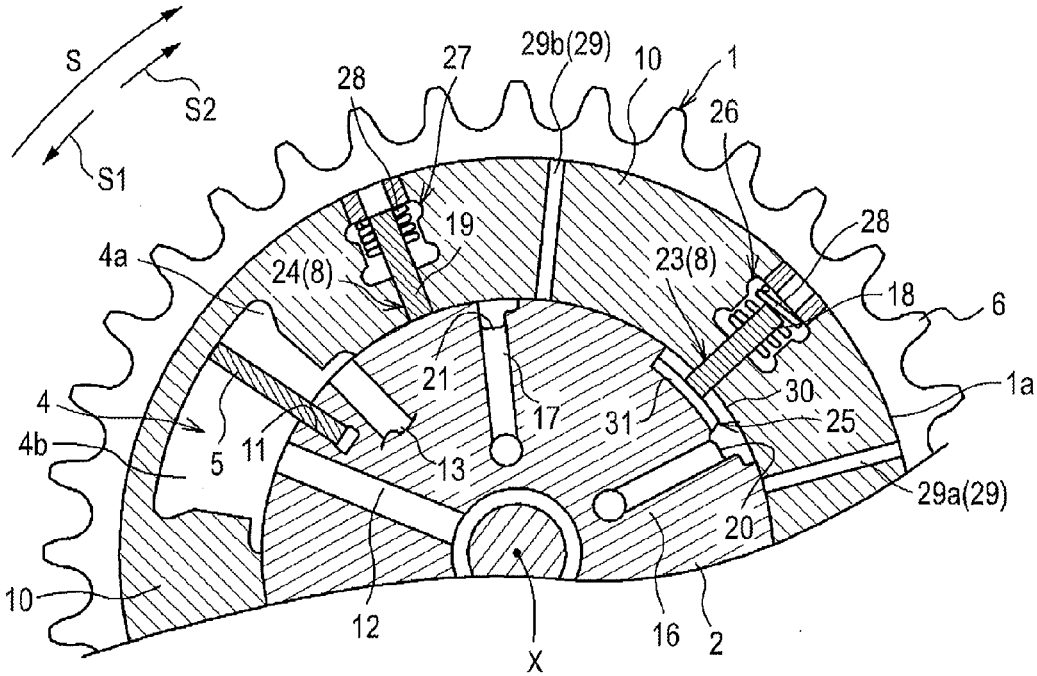
FIG. 8 is a cross-sectional view illustrating a specific operation state of a second embodiment.
Figure 9:
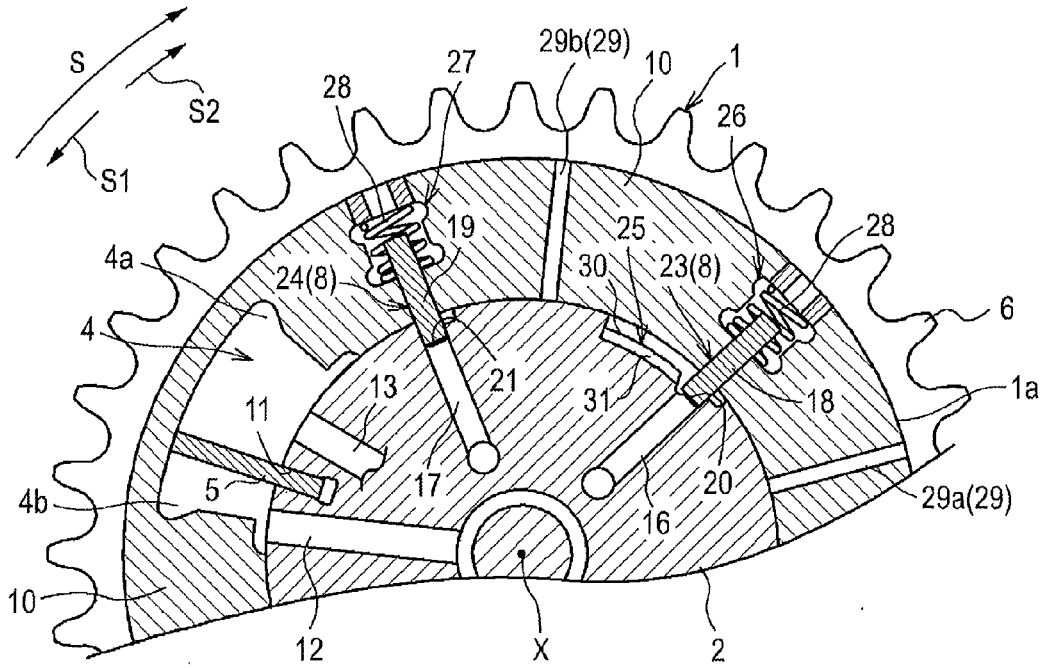
FIG. 9 is a cross-sectional view illustrating a specific operation state of a second embodiment.
Figure 10:
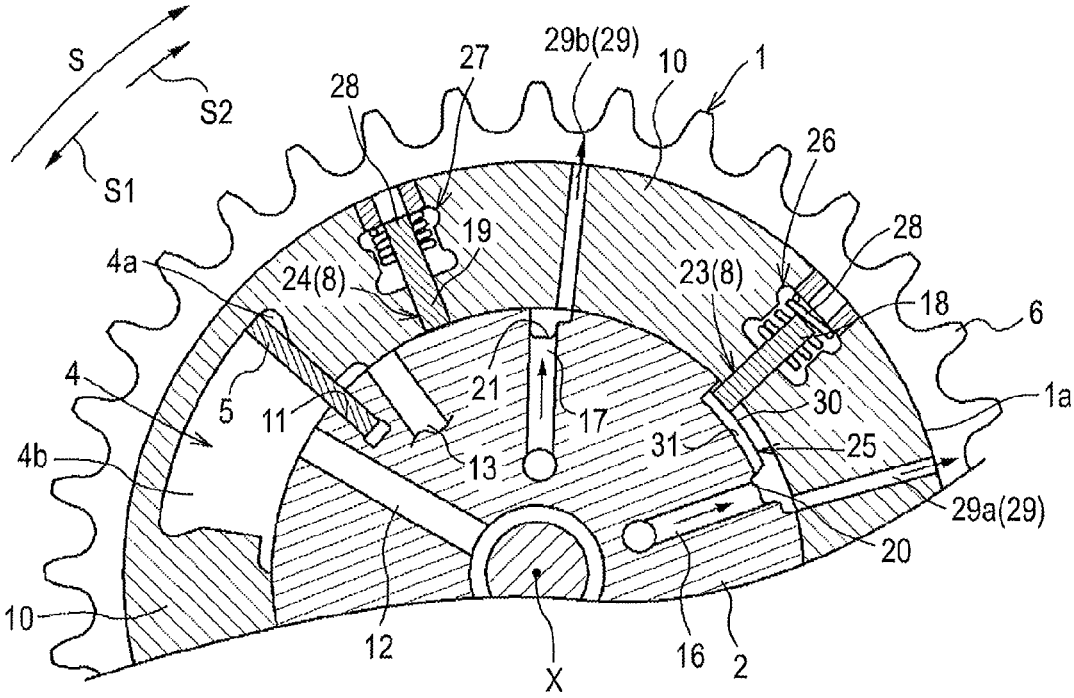
FIG. 10 is a cross-sectional view illustrating a specific operation state of a second embodiment.

FIG. 8 to FIG. 10 show other embodiments of the valve timing control device disclosed here, in which the retarded angle restriction-lock groove 20 is formed only one end side of the lock concave portion 25, and the advanced angle restriction-lock groove 21 is formed away from the other end of the lock concave portion 25.

As shown in FIG. 8, the rotation range of the inner rotor 2 to the outer rotor 1 from the intermediate lock phase to the retarded angle side (direction denoted by the arrow 51) is restricted by protruding the retarded angle restriction-lock piece 18 into the lock concave portion 25.

As shown in FIG. 9, the retarded angle restriction-lock piece 18 is locked to the retarded angle restriction-lock groove 20 and the advanced angle restriction-lock piece 19 is locked to the advanced angle restriction-lock groove 21, the relative rotational phase of the inner rotor 2 to the outer rotor 1 is restricted at the intermediate lock phase.

As shown in FIG. 10, the outer rotor 1 is provided with a retarded angle atmosphere open passage 29*a* which is in communication with the retarded angle restriction-lock groove 20, and an advanced angle atmosphere open passage 29*b* which is in communication with the advanced angle restriction-lock groove 21, when the relative rotational phase of the inner rotor 2 to the outer rotor 1 is at a specific phase (most advanced angle phase).

The lock concave portion 25 may be formed on the advanced angle restriction-lock groove 21. In this instance, the lock concave portion 25 is extended toward the advanced angle side with respect to the advanced angle restriction-lock groove 21, that is, the retarded angle restriction-lock groove 20 side: Consequently, in a case in which the inner rotor 2 is positioned at the retarded angle side upon stop of the engine, the advanced angle restriction-lock piece 19 protrudes first toward the lock concave portion 25 to restrict the rotational phase of the inner rotor 2 and thus easily perform the engagement of the retarded angle restriction-lock piece 18.

Other configurations are similar to those of the first embodiment.

Other Embodiments

1. In the valve timing control device disclosed here, the partition portion may be installed on the driving side rotational member.

2. In the valve timing control device disclosed here, the accommodation portion in which the lock member is mounted may be installed on the driven side rotational member.

3. The valve timing control device disclosed here may include a lock groove restricting the relative rotational phase of the driven side rotational member to the driving side rotational member at the most advanced angle phase or the most retarded angle phase when the lock member is locked.

4. The valve timing control device disclosed here may include a single lock member and a single lock groove to which the lock member is locked.

5. In the valve timing control device disclosed here, an interface surface between a rotor body 1*a* and a front plate 1*b* which constitute the outer rotor 1, an interface surface between a rotor body 1*a* and a rear plate 1*c* which constitute the outer rotor 1, or the front plate 1*b* or the rear plate 1*c* itself may be provided with the atmosphere open passage.

6. The valve timing control device disclosed here may be provided with an atmosphere open passage which is opened in the inside of the engine block.

7. In the valve timing control device disclosed here, the atmosphere open passage is in communication with the lock groove at the specific phase which is adjusted when the output torque required for the internal combustion engine during the relative rotational phase is large.

According to a first aspect of this disclosure, a valve timing control device includes a driving side rotational member synchronously rotatable with a crankshaft of an internal combustion engine; a driven side rotational member arranged coaxially with the driving side rotational member and synchronously rotatable with the camshaft that controls the opening and closing operation of valves of the internal combustion engine; a fluid pressure chamber formed by the driving side rotational member and the driven side rotational member; a partition portion installed on at least one of the driving side rotational member and the driven side rotational member to partition the fluid pressure chamber into an advanced angle chamber and a retarded angle chamber; a lock member mounted in an accommodation portion formed in either the driving side rotational member or the driven side rotational member and protruding and withdrawing with respect to the rotational member opposite to the accommodation portion; a lock groove formed in the opposite rotational member so that the lock member protrudes and is locked to the lock groove, the lock groove confining a relative rotational phase of the driven side rotational member with respect to the driving side rotational member at a most advanced angle phase, a most retarded angle, or a predetermined phase between the most advanced angle phase and the most retarded angle when the lock member is locked; and a lock release passage supplying an operating fluid to the lock member to withdraw the lock member from the lock groove, wherein the lock release passage is in communication with the lock groove, and the rotational member formed with the accommodation portion is provided with an atmosphere open passage which is in communication with the lock groove when the relative rotational phase is at a specific phase.

According to the valve timing control device of this disclosure, since the lock release passage is in communication with the lock groove, when the relative rotational phase of the driven side rotational member with respect to the driving side rotational member is at a specific phase, the lock groove is in communication with the atmosphere open passage, the operating fluid of the lock release passage passes through the lock groove and the atmosphere opening passage, and then is discharged outwardly.

Consequently, in a case where foreign substances remain in the lock groove, the foreign substances can be discharged outwardly together with the operating fluid, thereby preventing the foreign substances from jamming between the lock member and the lock groove for a long period of time.

In addition, according to the valve timing control device of this disclosure, when the internal combustion engine is actually used and immediately after the valve timing control device is attached to the internal combustion engine, if the relative rotational phase is set to a specific phase by supplying the operating fluid to the valve timing control device, it is possible to discharge the foreign substances at that time.

Consequently, before the internal combustion engine is actually used, for example, it is possible to discharge the foreign substances when the valve timing control device is attached to a vehicle of the internal combustion engine or is inspected. In this instance, by controlling the valve timing control device so as not to make the relative rotational phase at the specific phase at the time of actually using the internal combustion engine, so that there may be a configuration in which a circumferential groove (lock concave portion) of the driving side rotational member or the driven side rotational member which will be described below is not formed.

According to a second aspect of this disclosure, when the atmosphere open passage is in communication with the lock groove, the pressure of the operating fluid in the fluid pressure chamber is set to be equal to or more than the minimum operating pressure capable of adjusting the relative rotational phase.

With the above configuration, even though the pressure of the operating fluid in the fluid pressure chamber is decreased by communication between the atmosphere open passage and the lock groove, it is possible to suppress the adjustment of the relative rotational phase from being difficult. For this reason, it is possible to perform the adjustment of relative rotational phase quickly even though the atmosphere open passage is in communication with the lock groove.

According to a third aspect of this disclosure, when the atmosphere open passage is in communication with the lock groove, the pressure of the operating fluid in the fluid pressure chamber is set to be equal to or more than a pressure capable of suppressing a fluctuation of the relative rotational phase in the advanced angle direction and a retarded angle direction due to fluctuation in torque applied from the camshaft.

According to the configuration, even though the pressure of the operating fluid in the fluid pressure chamber is decreased by the communication of the atmosphere open passage and the lock groove, it is possible to suppress the fluctuation of the relative rotational phase due to the fluctuation in the torque. Consequently, it is possible to suppress the opening or closing time of a suction valve or a discharge valve from being unintentionally varied. In this instance, the pressure of the operating fluid in the fluid pressure chamber which can suppress the fluctuation of the relative rotational phase may be a pressure to ensure that the fluctuation of the relative rotational phase due to torque fluctuation is ±2° CA or less.

According to a fourth aspect of this disclosure, the atmosphere open passage is installed in such a manner that the atmosphere open passage is in communication with the lock groove at a specific phase of the relative rotational phase which is adjusted when revolutions of the internal combustion engine are high or when the output torque required for the internal combustion engine is high.

Generally, the supply of the operating fluid to the valve timing control device is performed by using discharge oil of a mechanical pump provided in the internal combustion engine. When the revolutions of the internal combustion engine are high or when the output torque required for the internal combustion engine is high, the discharge pressure from the pump is increased.

With the configuration, since the revolutions of the internal combustion engine are high and the output torque required for the internal combustion engine is high, the foreign substances can be vigorously discharged outwardly through the atmosphere open passage by using the operating fluid with the high discharge pressure from the pump. Consequently, the foreign substances staying in the lock groove can be effectively discharged outwardly together with the operating fluid.

According to a fifth aspect of this disclosure, the driven side rotational member rotating in an inner circumferential side of the driving side rotational member is provided with the lock groove, and the driving side rotational member is provided with the atmosphere open passage along a radial direction of the rotational member.

The foreign substances stayed in the lock groove are applied with a centrifugal force generated by the rotation of the rotational member. In a case where the foreign substances are large metal pieces or metal powder having specific gravity greater than that of the operating fluid, large centrifugal force is applied to the foreign substances as compared with the operating fluid.

With the configuration, the foreign substances with the specific gravity greater than that of the operating fluid can be smoothly discharged outwardly along the atmosphere open passage formed along the radial direction of the rotational member by using the centrifugal force applied to the foreign substances, as well as the flow force of the operating force.

According to a sixth aspect of this disclosure, a circumference of the opposite rotational member is provided with a lock concave portion, which opens the lock groove, in a circumferential direction. In order to communicate the lock groove and the atmosphere open passage in a case where the lock member protrudes and abuts against the bottom portion of the lock concave portion, at a specific phase in which the lock groove is in communication with the atmosphere open passage, the bottom portion of the lock concave portion is provided with a groove formed in a circumferential direction of the driving side rotational member or the driven side rotational member.

With the above configuration, if the lock member protrudes from the lock concave portion, the relative rotational range between the driving side rotational member and the driven side rotational member is restricted. The lock concave portion is provided with the lock groove. For this reason, the lock member protruding into the lock concave portion can be locked to the lock groove by the relative rotation between the driving side rotational member and the driven side rotational member. Therefore, it is possible to easily restrict the relative rotational phase of the driven side rotational member to the driving side rotational member at a most advanced angle phase, a most retarded angle, or a predetermined phase between the most advanced angle phase and the most retarded angle phase.

When the driving side rotational member and the driven side rotational member are relatively rotated to be at a specific phase, the lock member is withdrawn from the lock member by acting the operating fluid of the lock release passage on the lock member.

If the atmosphere open passage is in communication with the lock groove at a specific phase, the pressure of the operating fluid is lowered. For this reason, the lock member tends to protrude into the lock concave portion, thereby interrupting the communication between the lock groove and the atmosphere open passage.

If the communication between the lock groove and the atmosphere open passage is interrupted, there is a problem in that the foreign substances staying in the lock groove are not discharged outwardly.

With the above configuration, in a case where the lock member abuts against the bottom portion of the lock concave portion, the lock groove can be in communication with the atmosphere open passage.

Consequently, it is possible to reliably discharge outwardly the foreign substances staying in the lock groove.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly it is expressly intended that all such variations, changes and equivalents which fall within the spirit and scope of the present invention as defined in the claims, be embraced thereby.

What is claimed is:

1. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a fluid pressure chamber formed by the driving side rotational member and the driven side rotational member;

a partition portion installed on at least one of the driving side rotational member and the driven side rotational member to partition the fluid pressure chamber into an advanced angle chamber and a retarded angle chamber;

a lock member mounted in an accommodation portion formed in either the driving side rotational member or the driven side rotational member and protruding and withdrawing with respect to the rotational member opposite to the accommodation portion;

a lock groove formed in the opposite rotational member so that the lock member protrudes and is locked to the lock groove, the lock groove confining a relative rotational phase of the driven side rotational member with respect to the driving side rotational member at a most advanced angle phase, a most retarded angle, or a predetermined phase between the most advanced angle phase and the most retarded angle when the lock member is locked;

a lock release passage applying an operating fluid to the lock member to withdraw the lock member from the lock groove, wherein the lock release passage is in communication with the lock groove, the rotational member formed with the accommodation portion is provided with an atmosphere open passage which is in communication with the lock groove when the relative rotational phase is at a specific phase, wherein the atmosphere open passage is at an angular position different from the accommodation portion and does not include the lock member inside of the atmosphere open passage, the atmosphere open passage having a cross-section smaller than that of the lock release passage; and the hydraulic fluid discharged from the atmosphere open passage to outside the rotational member formed with the accommodation portion when the relative rotational phase is at the specific phase is greater than the hydraulic fluid discharged from the atmosphere open passage to outside the rotational member formed with the accommodation portion when the lock member is positioned in the lock groove.

2. The valve timing control device according to claim 1, wherein when the atmosphere open passage is in communication with the lock groove, a pressure of the operating fluid in the fluid pressure chamber is set to be equal to or more than a minimum operating pressure capable of adjusting the relative rotational phase.

3. The valve timing control device according to claim 1, wherein when the atmosphere open passage is in communication with the lock groove, the pressure of the operating fluid in the fluid pressure chamber is set to be equal to or more than a pressure capable of suppressing a fluctuation of the relative rotational phase in an advanced angle direction and a retarded angle direction due to fluctuation in torque applied from the camshaft.

4. The valve timing control device according to claim 2, wherein when the atmosphere open passage is in communication with the lock groove, the pressure of the operating fluid in the fluid pressure chamber is set to be equal to or more than a pressure capable of suppressing a fluctuation of the relative rotational phase in an advanced angle direction and a retarded angle direction due to fluctuation in torque applied from the camshaft.

5. The valve timing control device according to claim 1, wherein the atmosphere open passage is installed in such a manner that the atmosphere open passage is in communication with the lock groove at a specific phase of the relative rotational phase, the relative rotational phase being adjusted when revolutions of the internal combustion engine are high or when output torque required for the internal combustion engine is high.

6. The valve timing control device according to claim 2, wherein the atmosphere open passage is installed in such a manner that the atmosphere open passage is in communication with the lock groove at a specific phase of the relative rotational phase, the relative rotational phase being adjusted when revolutions of the internal combustion engine are high or when output torque required for the internal combustion engine is high.

7. The valve timing control device according to claim 3, wherein the atmosphere open passage is installed in such a manner that the atmosphere open passage is in communication with the lock groove at a specific phase of the relative rotational phase, the relative rotational phase being adjusted when revolutions of the internal combustion engine are high or when output torque required for the internal combustion engine is high.

8. The valve timing control device according to claim 1, wherein the driven side rotational member rotating in an inner circumferential side of the driving side rotational member is provided with the lock groove, and the driving side rotational member is provided with the atmosphere open passage along a radial direction of the rotational member.

9. The valve timing control device according to claim 2, wherein the driven side rotational member rotating in an inner circumferential side of the driving side rotational member is provided with the lock groove, and the driving side rotational member is provided with the atmosphere open passage along a radial direction of the rotational member.

10. The valve timing control device according to claim 3, wherein the driven side rotational member rotating in an inner circumferential side of the driving side rotational member is provided with the lock groove, and the driving side rotational member is provided with the atmosphere open passage along a radial direction of the rotational member.

11. The valve timing control device according to claim 4, wherein the driven side rotational member rotating in an inner circumferential side of the driving side rotational member is provided with the lock groove, and the driving side rotational member is provided with the atmosphere open passage along a radial direction of the rotational member.

12. The valve timing control device according to claim 1, wherein a circumference of the opposite rotational member is provided with a lock concave portion, which opens the lock groove, in a circumferential direction, and in order to communicate the lock groove and the atmosphere open passage in a case where the lock member protrudes and abuts against a bottom surface of the lock concave portion, at a specific phase in which the lock groove is in communication with the atmosphere open passage, a lower portion of the lock concave portion is provided with a groove formed in a circumferential direction of the driving side rotational member or the driven side rotational member.

13. The valve timing control device according to claim 2, wherein a circumference of the opposite rotational member is provided with a lock concave portion, which opens the lock groove, in a circumferential direction, and in order to communicate the lock groove and the atmosphere open passage in a case where the lock member protrudes and abuts against a bottom surface of the lock concave portion, at a specific phase in which the lock groove is in communication with the atmosphere open passage, a lower portion of the lock concave portion is provided with a groove formed in a circumferential direction of the driving side rotational member or the driven side rotational member.

14. The valve timing control device according to claim 3, wherein a circumference of the opposite rotational member is provided with a lock concave portion, which opens the lock groove, in a circumferential direction, and in order to communicate the lock groove and the atmosphere open passage in a case where the lock member protrudes and abuts against a bottom surface of the lock concave portion, at a specific phase in which the lock groove is in communication with the atmosphere open passage, a lower portion of the lock concave portion is provided with a groove formed in a circumferential direction of the driving side rotational member or the driven side rotational member.

15. The valve timing control device according to claim 4, wherein a circumference of the opposite rotational member is provided with a lock concave portion, which opens the lock groove, in a circumferential direction, and in order to communicate the lock groove and the atmosphere open passage in a case where the lock member protrudes and abuts against a bottom surface of the lock concave portion, at a specific phase in which the lock groove is in communication with the atmosphere open passage, a lower portion of the lock concave portion is provided with a groove formed in a circumferential direction of the driving side rotational member or the driven side rotational member.

16. The valve timing control device according to claim 7, wherein a circumference of the opposite rotational member is provided with a lock concave portion, which opens the lock groove, in a circumferential direction, and in order to communicate the lock groove and the atmosphere open passage in a case where the lock member protrudes and abuts against a bottom surface of the lock concave portion, at a specific phase in which the lock groove is in communication with the atmosphere open passage, a lower portion of the lock concave portion is provided with a groove formed in a circumferential direction of the driving side rotational member or the driven side rotational member.

17. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a fluid pressure chamber formed by the driving side rotational member and the driven side rotational member;

a partition portion installed on at least one of the driving side rotational member and the driven side rotational member to partition the fluid pressure chamber into an advanced angle chamber and a retarded angle chamber;

a lock member mounted in an accommodation portion formed in either the driving side rotational member or the driven side rotational member and protruding and withdrawing with respect to the rotational member opposite to the accommodation portion;

a lock groove formed in the opposite rotational member so that the lock member protrudes and is locked to the lock groove, the lock groove confining a relative rotational phase of the driven side rotational member with respect to the driving side rotational member at a most advanced angle phase, a most retarded angle, or a predetermined phase between the most advanced angle phase and the most retarded angle when the lock member is locked;

a lock release passage applying an operating fluid to the lock member to withdraw the lock member from the lock groove;

wherein the lock release passage is in communication with the lock groove;

an atmosphere open passage capable of allowing the operating fluid in the lock groove to maintain locking of the lock member while being applied to the lock member;

the atmosphere open passage being a through passage possessing an inner surface surrounding an interior of the through passage and configured so that the hydraulic fluid is flowable through the entire interior of the through passage; and wherein the atmosphere open passage is at an angular position different from the accommodation portion.

18. A valve timing control device comprising:

a driving side rotational member synchronously rotatable with a crankshaft of an internal combustion engine;

a driven side rotational member arranged coaxially with the driving side rotational member and synchronously rotatable with a camshaft that controls an opening and closing operation of valves of the internal combustion engine;

a fluid pressure chamber formed by the driving side rotational member and the driven side rotational member;

a partition portion installed on at least one of the driving side rotational member and the driven side rotational member to partition the fluid pressure chamber into an advanced angle chamber and a retarded angle chamber;

two lock members mounted in respective accommodation portions formed in either the driving side rotational member or the driven side rotational member and protruding and withdrawing with respect to the rotational member opposite to the accommodation portions;

two lock grooves formed in the opposite rotational member so that each of the lock members protrudes and is locked to a respective one of the lock grooves, the lock grooves confining a relative rotational phase of the driven side rotational member with respect to the driving side rotational member at a most advanced angle phase, a most retarded angle, or a predetermined phase between the most advanced angle phase and the most retarded angle when the lock members are locked;

at least one lock release passage applying an operating fluid to at least one of the lock members to withdraw the at least one lock member from the respective lock groove;

wherein the at least one lock release passage is in communication with the respective lock groove;

the rotational member formed with the accommodation portions is provided with an atmosphere open passage which is in communication with the at least one of the lock grooves when the relative rotational phase is at a specific phase; and wherein the atmosphere open passage is at an angular position different from the accommodation portions.

* * * * *